US011877633B1

(12) United States Patent
Wongdeelert

(10) Patent No.: US 11,877,633 B1
(45) Date of Patent: Jan. 23, 2024

(54) ADJUSTABLE INTERLOCKING WALLET

(71) Applicant: Boonchoke Wongdeelert, Bangkok (TH)

(72) Inventor: Boonchoke Wongdeelert, Bangkok (TH)

( * ) Notice: Subject to any disclaimer, the term of this patent is extended or adjusted under 35 U.S.C. 154(b) by 0 days.

(21) Appl. No.: 17/571,453

(22) Filed: Jan. 8, 2022

(51) Int. Cl.
*A45C 1/06* (2006.01)
*A45C 13/10* (2006.01)

(52) U.S. Cl.
CPC ..... *A45C 1/06* (2013.01); *A45C 13/1076* (2013.01)

(58) Field of Classification Search
CPC ..... A45C 1/06; A45C 13/1076
See application file for complete search history.

(56) References Cited

U.S. PATENT DOCUMENTS 1,908,038 A * 5/1933 Mackenzie ..... A41F 9/002 2/339
2,030,018 A * 2/1936 Mouilbau ..... A41F 9/002 2/339
2,165,928 A * 7/1939 Krischer ..... A44B 11/2596 24/DIG. 38
2,383,748 A * 8/1945 Sherman ..... A41F 9/002 224/663
6,290,112 B1 * 9/2001 Iver ..... A44B 11/266 24/3.12
8,001,662 B1 * 8/2011 Guber ..... A44B 11/25 24/321
8,393,016 B2 * 3/2013 Wilkins-Gaudio ..... A41F 9/002 2/338
8,636,452 B2 * 1/2014 Summer ..... B26D 3/001 410/101
2008/0061098 A1 * 3/2008 Hoffner ..... A45F 5/02 224/661
2011/0167540 A1 * 7/2011 Little ..... A41F 9/002 2/338
2016/0003578 A1 * 1/2016 Vertreese ..... F41C 33/0236 224/192
2016/0088905 A1 * 3/2016 Perry ..... A44B 11/2596 2/338
2017/0127766 A1 * 5/2017 Sixt ..... A44B 11/008

* cited by examiner

*Primary Examiner* — Tri M Mai
(74) *Attorney, Agent, or Firm* — Jeffrey Roddy

(57) ABSTRACT

An adjustable interlocking wallet includes a body comprising a flexible loop of stretchable material and at least two clasps which interlock with one another to secure the wallet in a closed position. The wallet also includes clips that are attachable to the loop, slide thereon and retain the at least two clasps on the body.

2 Claims, 6 Drawing Sheets

ADJUSTABLE INTERLOCKING WALLET

FIELD OF THE INVENTION

The present invention relates to containment of personal articles and more specifically wallets, billfolds, hand purses and the like.

BACKGROUND

Various solutions directed to the containment of personal papers, monies and credit cards have been produced in the past yet the same basic design constraints have prevailed. Many wallets are inflexible while others are limited in the number of articles that can be accommodated. Moreover, both fabric and leather wallets are sensitive to moisture, wear out and require replacement.

It would be desirable to provide a componentized wallet, billfold or pocketbook with an easily replaceable body.

It would be desirable if the foregoing componentized wallet included interlocking clasps.

It would be desirable if the foregoing replaceable body included a flexible material.

It would be desirable if the foregoing componentized wallet, billfold or pocketbook were compact and slim.

It would be desirable if the foregoing componentized wallet, billfold or pocketbook were expandable and stretchable.

SUMMARY

In a general example implementation according to present invention, an adjustable interlocking wallet includes a body comprising a flexible loop of stretchable material and at least two clasps which interlock with one another to secure the wallet in a closed position.

In an aspect combinable with any other aspect described herein, the body may include an elastic element.

In an aspect combinable with any other aspect described herein, the body may include a top and bottom opening, or only a top opening.

In an aspect combinable with any other aspect described herein, the wallet may include at least one attachable clip that is configured to slide along a length of the body.

In an aspect combinable with any other aspect described herein, both the at least two clasps are attachable and detachable from the body.

In an aspect combinable with any other aspect described herein, the at least two clasps are shaped to readily tensionably join and unjoin.

In an aspect combinable with any other aspect described herein, the at least one attachable clip is shaped and sized to retain the cards by forming a localized pinching compression of the body at points adjacent and abutting the retained cards.

In an aspect combinable with any other aspect described herein, the at least one attachable clip includes at least two attachable clips.

In an aspect combinable with any other aspect described herein, the at least one attachable clip includes at least three attachable clips.

In an aspect combinable with any other aspect described herein, the at least one attachable clip includes a first clip disposed at a first end of the body, a second clip disposed of a second end of the body which is opposite the first end, and, a third clip disposed transversely in the middle of the band.

In an aspect combinable with any other aspect described herein, the end clips include a portion that resides inside the loop and a portion that resides outside the loop.

In an aspect combinable with any other aspect described herein, the clasps have portions completely circumjacent the outer surfaces of the band.

In an aspect combinable with any other aspect described herein, the elastic band may be wholly or partially elastic, and may be constructed of one or more types of material; e.g., braided, woven or knitted elastic fabric and/or natural or synthetic leather.

BRIEF DESCRIPTION OF THE DRAWING FIGURES

LIST OF THE REFERENCED ELEMENTS

Figure 1:
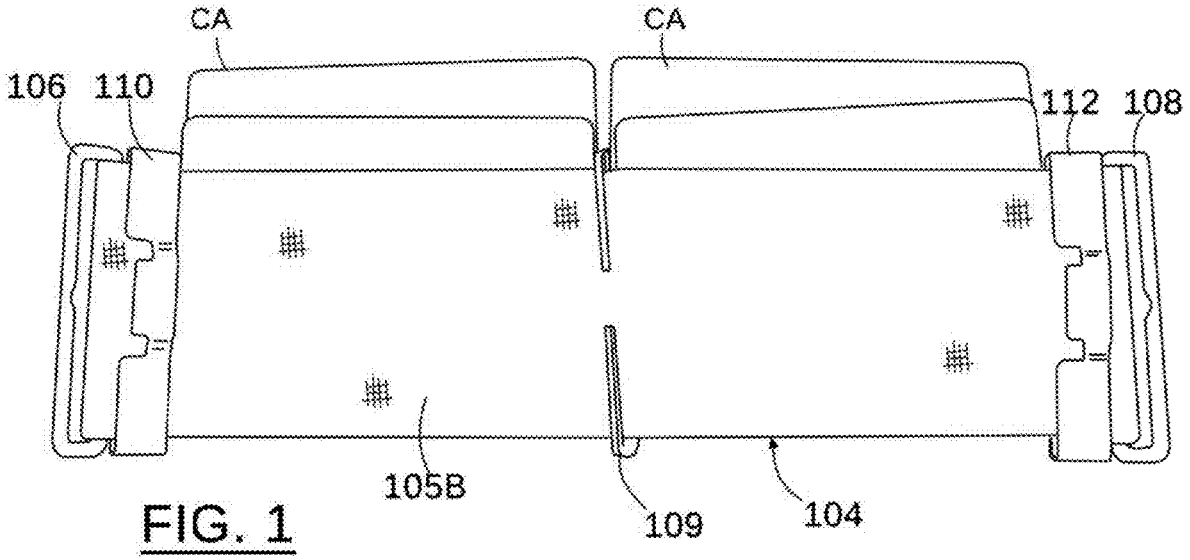
FIG. 1 is a side view showing an adjustable interlocking wallet in an open unsecured position.

100 wallet
104 loop band
105A first/outer side
105B second/outer side
105C inner surfaces
106, 108 end clips
109 middle clip
110, 112 end clasps
115A clasp slot/notch
115B raised portion
118 clip gap
119 clip notch
120 band patch

Definitions

In the following description, unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references listed in this disclosure are incorporated by reference in their entirety for all purposes. In case of conflict, the present specification, including explanations of terms, will control. In addition, the materials, methods, and examples are illustrative only and not intended to be limiting.

DETAILED DESCRIPTION

Referring generally to FIGS. 1-9, an adjustable interlocking wallet (100) includes a body (104) comprising a flexible loop of stretchable material and at least two clasps (110, 112) which interlock with one another to secure the wallet in a closed position. Body (104) includes two outer sides (105A, 105B). The wallet also includes clips (106, 108, 109) that are attachable to the loop, slide thereon and secure the at least two clasps on the body. In some implementations, the wallet may include two clips (106, 108) that are attachable and removable from the loop band by inserting an edge of one side of the band though gaps (118). Clasps (110, 112) lack the gaps (118) of the clips (106, 108, 109) and are configured to slip over both sides (105A, 105B) of the loop band, while each clip surrounds only a single side (105A, 105B) at a time. Typically two clips are disposed one at each end of the loop band and the two clasps are disposed between the two end clips as shown in (FIG. 1). Each end clip retains a paired adjacent clasp to the loop band. Typically, a third (middle) clip (109) is disposed in the center of the band and divides the band into two slots or recesses between sides (105A, 105B), one slot on either side of the middle clip (109), wherein slot is adapted to receive cards (CA) of various kinds; e.g., business cards, credit cards, etc. as shown.

Figure 2:
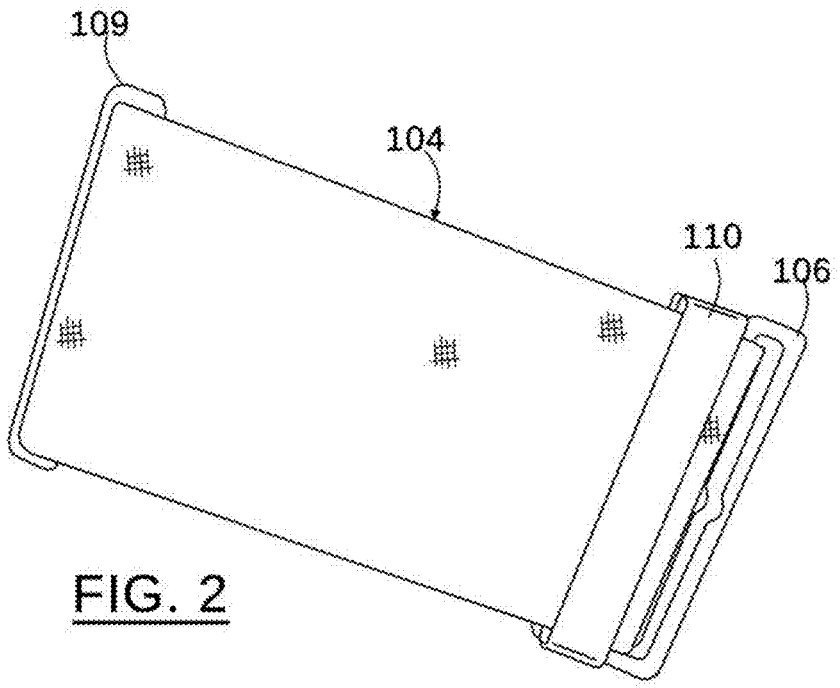
FIG. 2 is a side view thereof showing the wallet in an closed secured position.

FIG. 2 shows the wallet of (FIG. 1) in a closed and secured position.

Figure 3:
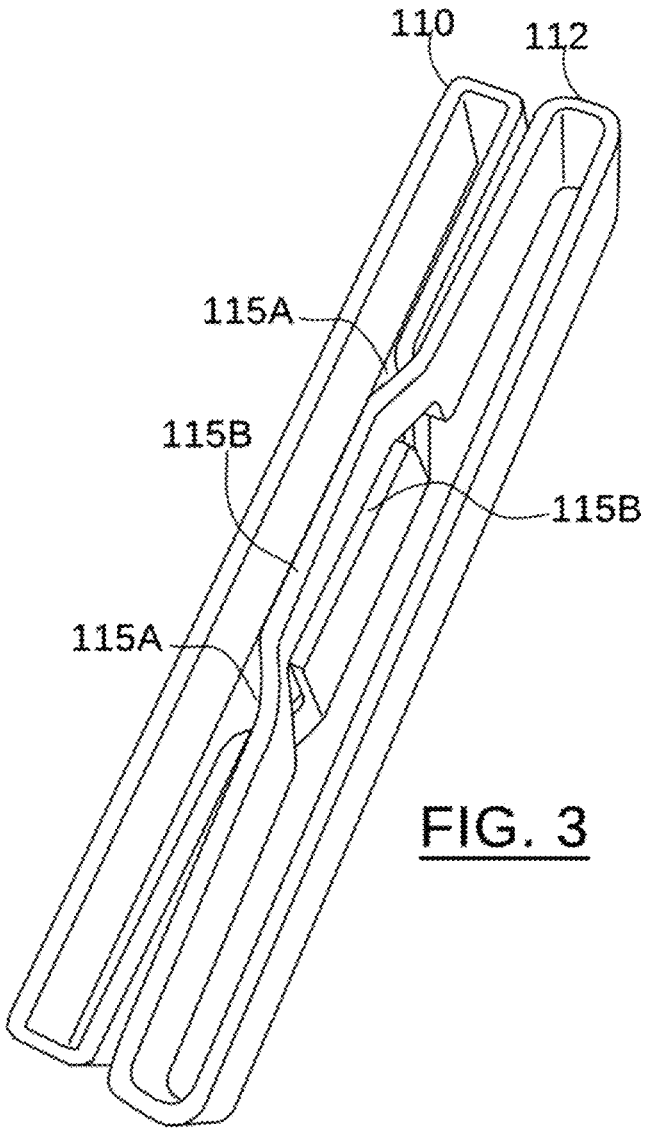
FIG. 3 is a detail view showing example joined clasp members of an adjustable wallet.

FIG. 3 is an enlarged detail view showing a pair of end clasps (110, 112) interconnected. The end clasps may be identically formed as shown and include a rectangular band that may be formed from a metal strip, plastic, composite or another suitably stiff material. One side of each clasp has a raised portion (115B) with slots/notches (115A) such that facing clasps (110, 112) can mateably interlock as shown.

Figure 4:
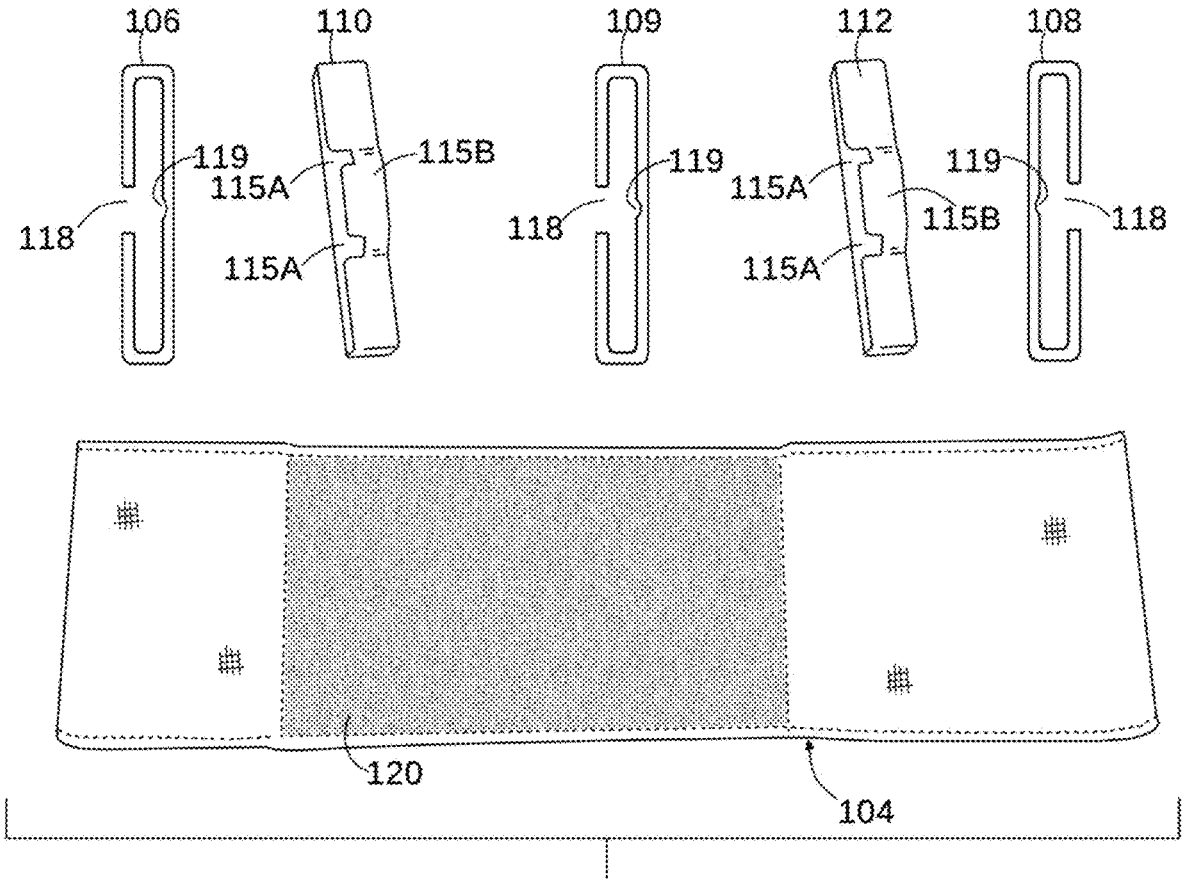
FIG. 4 is a side view showing example components of an adjustable interlocking wallet.

FIG. 4 shows a wallet in a disassembled state, where the elastic looped band (104) has been separated from the three clips (106, 108, 109) and the two clasps (110, 112). Band (104) is shown including two types of material/fabric that may be elastic, inelastic, or decorative in nature. In some implementations patch (120) is the portion facing out when the wallet is in the secured and closed position.

Figure 5:
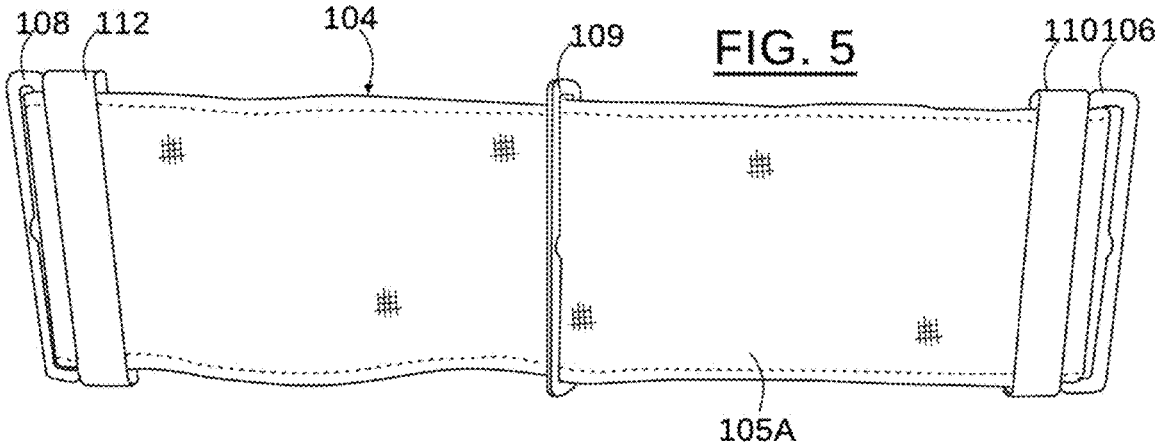
FIG. 5 shows a first side of an adjustable interlocking wallet.
Figure 6:
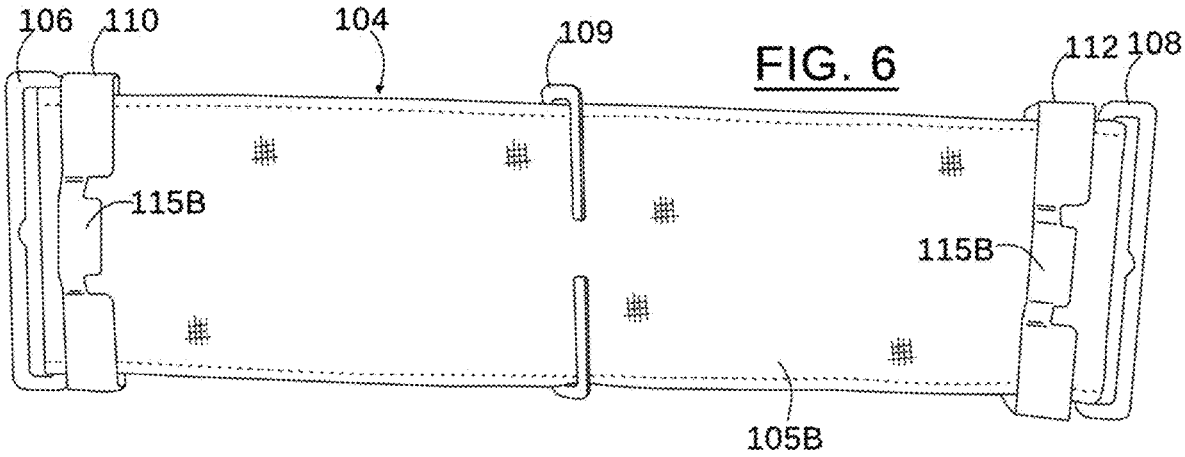
FIG. 6 shows a second side of an adjustable interlocking wallet.

FIGS. 5 and 6 show outer and inner sides respectively, of the wallet (100).

Figure 7:
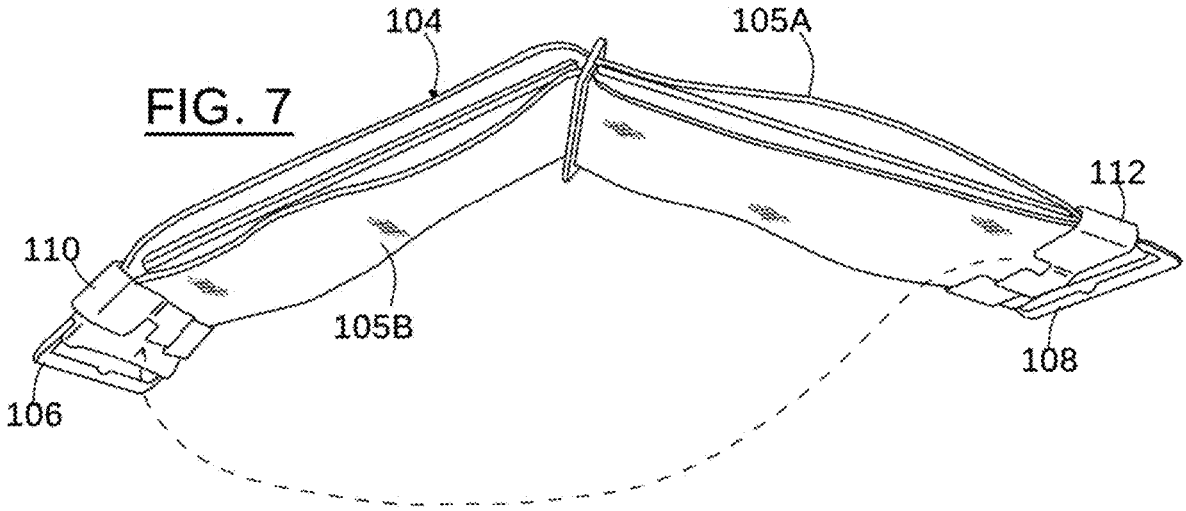
FIG. 7 is an edge view looking into a recess between the first and second sides of the wallet.

FIG. 7 is an edge view of wallet (100) showing a pair of slots produced by dividing the wallet with clip (109) equally along the median. The dashed line with arrow indicates how the ends of the wallet are brought together and the end clasps (110, 112) are interlocked.

Figure 8:
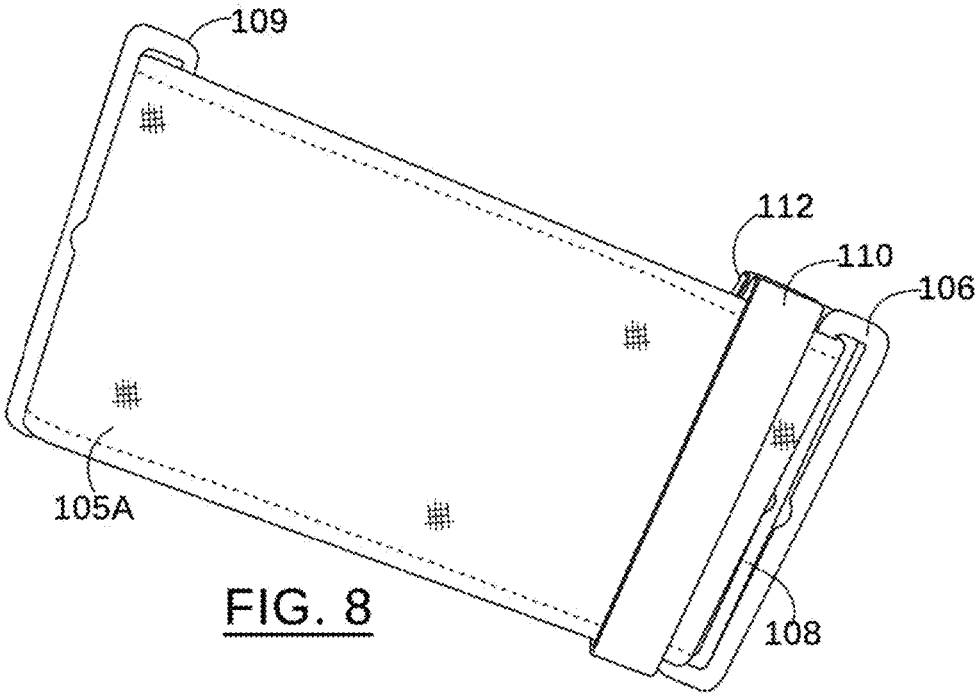
FIG. 8 is a side view of a closed wallet.

FIG. 8 shows the outside of a closed and secured wallet.

Figure 9:
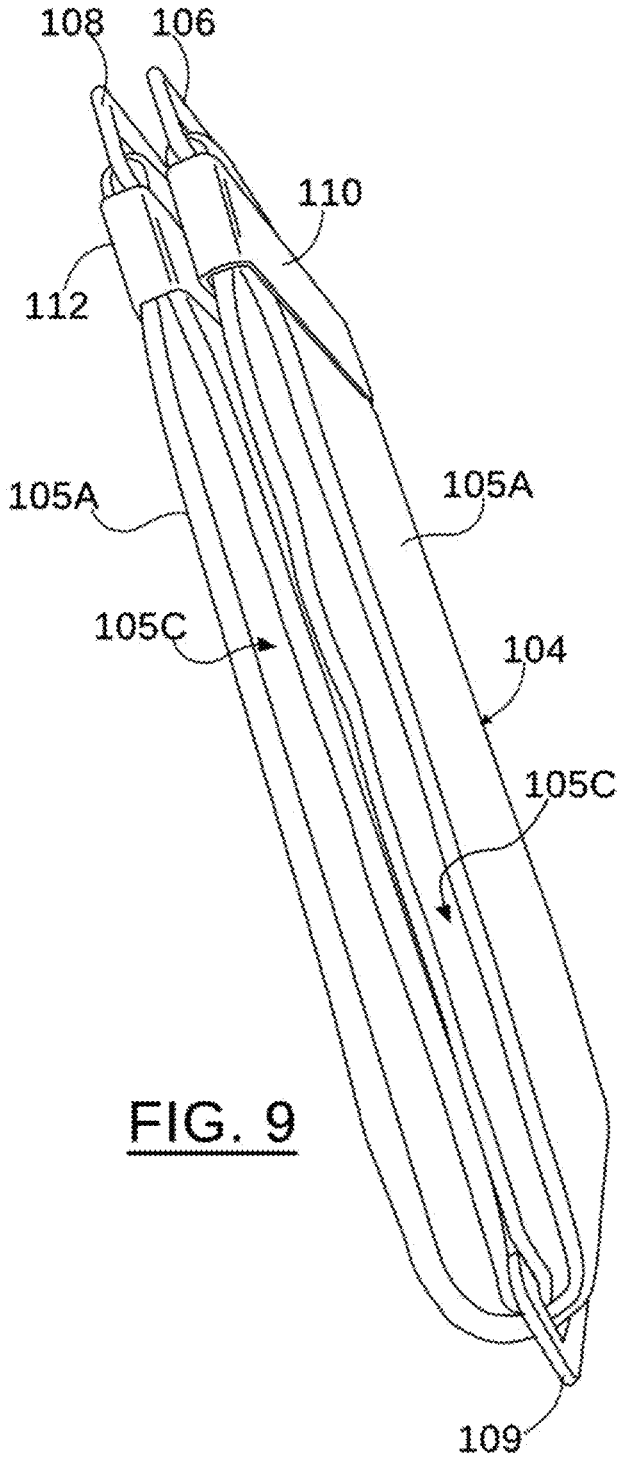
FIG. 9 is an edge view of a closed wallet and contents.

FIG. 9 shows an edge view of a closed and secured wallet with interior recesses or slots 115C which are adapted to receive and retain cards and the like.

Accordingly, it is intended that this disclosure encompass any further modifications, changes, rearrangements, substitutions, alternatives, design choices, implementations and embodiments as would be appreciated by those of ordinary skill in the art having benefit of this disclosure, and falling within the spirit and scope of the following claims.

What is claimed is:

1. A personal article comprising:

at least two same shaped clasps, each of the at least two clasps being a closed band and including a first substantially planar side, an upper side, a lower side and a second side opposite the first substantially planar side, the second side including a raised medial portion disposed between a pair of notches, a gap is formed between the first substantially planar side, the upper side, the lower side and the second side and the symmetrically shaped clasps are adapted to interlock together;

at least two end clips, each of the at least two end clips include a top side and a bottom side which are oppositely disposed and a left side and a right side which are oppositely disposed and the left side includes a break bordered by a pair of oppositely disposed prongs;

a closed elastic band folded on itself forming a pair of abutting plies, each ply of the pair of abutting plies defining a side, each of the at least two end clips mounted at opposite ends of the closed elastic band via the pair of prongs such that left side and right side of each of the at least two clips are circumjacent a single ply of the pair of abutting plies, and, the at least two clasps mounted to the elastic band between the at least two end clips, each of the at least two clasps are circumjacent the pair of abutting plies, the pair of abutting plies form a slot adapted to receive and secure planar items.

2. The personal article according to claim 1, further comprising a medial end clip disposed between the at least two clasps.

* * * * *